United States Patent [19]

Guo et al.

[11] Patent Number: 4,943,737

[45] Date of Patent: Jul. 24, 1990

[54] BICMOS REGULATOR WHICH CONTROLS MOS TRANSISTOR CURRENT

[75] Inventors: Tzen-Wen Guo, Milpitas; Jonathan J. Stinehelfizer, San Jose, both of Calif.

[73] Assignee: Advanced Micro Devices, Inc., Sunnyvale, Calif.

[21] Appl. No.: 421,230

[22] Filed: Oct. 12, 1989

[51] Int. Cl.[5] ..... G05F 3/16

[52] U.S. Cl. ..... 307/296.7; 307/296.6; 307/310; 323/315; 323/907

[58] Field of Search ..... 307/296.6–296.8, 307/310; 323/314–316, 907

[56] References Cited

U.S. PATENT DOCUMENTS

| | | | |
|---|---|---|---|
| 4,302,718 | 11/1981 | Schade, Jr. | 307/296.7 X |
| 4,319,181 | 3/1982 | Wrathall | 307/296.7 X |
| 4,419,594 | 12/1983 | Gemmell et al. | 307/296.6 |
| 4,553,048 | 11/1985 | Bynum et al. | 307/310 X |
| 4,593,208 | 6/1986 | Single | 307/310 X |
| 4,769,589 | 9/1988 | Rosenthal | 323/907 X |
| 4,780,624 | 10/1988 | Nicollini et al. | 323/314 X |
| 4,792,748 | 12/1988 | Thomas et al. | 323/907 X |
| 4,855,618 | 8/1989 | Brokaw | 307/296.6 |
| 4,896,094 | 1/1990 | Greaves et al. | 323/314 |

FOREIGN PATENT DOCUMENTS 0006717 1/1986 Japan ..... 307/296.6

OTHER PUBLICATIONS

Liu, "Temperature Compensated Voltage Reference Soruce", *IBM T.D.B.*, vol. 14, No. 4, Sep. 1971, pp. 1223–1224.

Gray and Meyer, *Analysis* and *Design of Analog Integrated Circuits*, Wiley and Sons, New York, 1978, pp. 239–248.

*Primary Examiner*—David Hudspeth

*Attorney, Agent, or Firm*—Davis Chin

[57] ABSTRACT

A bipolar/CMOS regulator circuit for generating a CMOS gate-controlling voltage, which varies favorably with temperature, power supply voltage and process corner so as to yield a well-controlled CMOS current includes a bipolar bandgap regulator circuit portion (12) and a conversion circuit portion (14). The conversion circuit portion (14) is formed of a current mirror section (18), a current source section (20) and an output section (22).

11 Claims, 1 Drawing Sheet

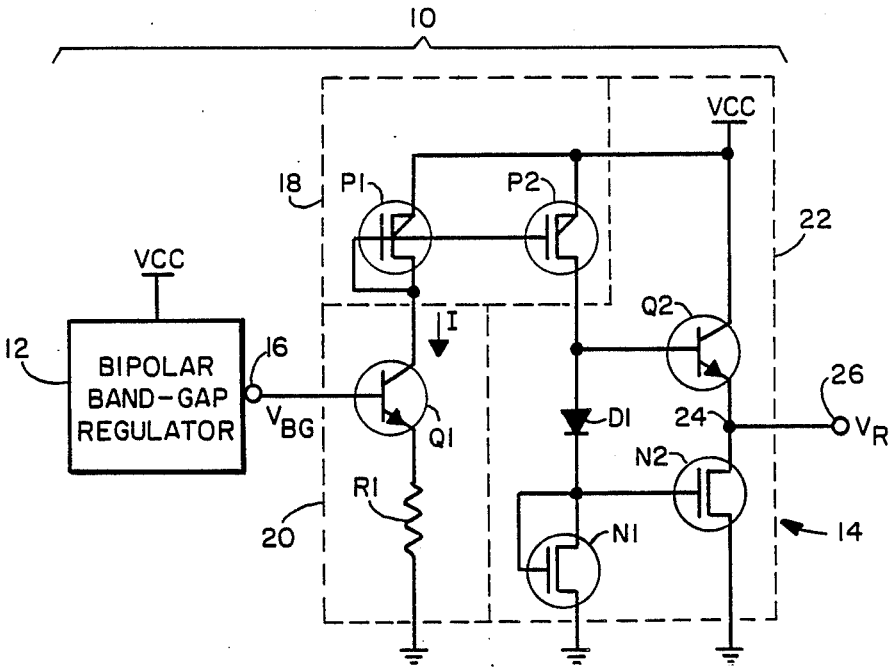
10
VCC
18
P1
P2
22
VCC
Q2
12
BIPOLAR
BAND-GAP
REGULATOR
16
I
26
$V_{BG}$
Q1
D1
24
$V_R$
N2
R1
20
N1
14

BICMOS REGULATOR WHICH CONTROLS MOS TRANSISTOR CURRENT

BACKGROUND OF THE INVENTION

This invention relates generally to a circuit which can control MOS transistor current precisely. The circuit utilizes bipolar and CMOS devices for generating a CMOS gate-controlling voltage, which varies favorably with temperature, power supply voltage, and process corners, so as to yield a well-controlled CMOS current.

Conventional bipolar regulator circuits, such as bandgap regulators employing only bipolar transistors are generally well known in the prior art and can provide a very good reference voltage. The major defects of these prior art circuits is that bipolar technology is very expensive and requires higher amounts of power for operation in circuits. Thus, bipolar technology is not as popular as CMOS technology. Circuits employing CMOS technology are much easier to manufacture and utilize much less power than the bipolar ones. However, CMOS circuits have the inherent problem of being unable to provide a precise control of voltage level and current. Accordingly, the voltage and/or current levels in CMOS circuits can change drastically due to temperature, supply voltage, or process variations.

It would therefore be desirable to provide a merged or composite bipolar/CMOS regulator circuit which combines the advantages of the bipolar transistor and CMOS transistor technologies together. As a result, bipolar transistors and CMOS transistors are merged or are arranged in a common semiconductor substrate in order to form an integrated circuit regulator device which can give a precise control of voltage level and CMOS current and can be manufactured at a relatively low cost, but yet provides a much improved performance.

SUMMARY OF THE INVENTION

Accordingly, it is a general object of the present invention to provide a bipolar/CMOS regulator circuit which is relatively simple and economical to manufacture and assemble, but yet overcomes the disadvantages of the conventional voltage reference circuits.

It is an object of the present invention to provide a bipolar/CMOS regulator circuit which successfully merges bipolar and CMOS technologies together so that MOS currents can be controlled as precisely as those in bipolar circuits.

It is another object of the present invention to provide a bipolar/CMOS regulator circuit for generating a CMOS gate-controlling voltage, which varies favorably with temperature, power supply voltage, and process corners so as to yield a well-controlled CMOS current.

It is still another object of the present invention to provide a bipolar/CMOS regulator circuit formed of a bandgap circuit portion and a conversion circuit portion which provides a CMOS gate-controlling voltage used as a gate bias voltage for an N-channel MOS transistor so as to yield a well-controlled current over the variations in temperature, power supply voltage and process corners.

In accordance with these aims and objectives, the present invention is concerned with the provision of a bipolar/CMOS regulator circuit for generating a CMOS gate-controlling voltage, which varies favorably with temperature, power supply voltage and process corners so as to yield a well-controlled CMOS current. The regulator circuit is comprised of a current mirror section, a current source section and an output section. The current mirror section includes a first P-channel MOS transistor and a second P-channel MOS transistor. The first P-channel transistor has its source connected to a supply potential and its gate and drain connected together. The second P-channel transistor has its source also connected to the supply potential and its gate connected to the gate of the first P-channel transistor. The current source section is formed of a first bipolar transistor and an emitter resistor. The first bipolar transistor has its collector connected to the drain of the first P-channel transistor, its base connected to receive a regulated reference voltage and its emitter connected to one end of the emitter resistor. The other end of the emitter resistor is connected to a ground potential.

The output section is formed of a diode, a first N-channel MOS transistor, a second bipolar transistor, and a second N-channel MOS transistor. The diode has its anode connected to the drain of the second P-channel transistor and its cathode connected to the gate and drain of the first N-channel transistor. The first N-channel transistor has its source connected to the ground potential. The second bipolar transistor has its collector connected to the supply potential, its base connected to the anode of the diode, and its emitter connected to the drain of the second N-channel transistor and to an output node for generating a CMOS gate-controlling voltage. The second N-channel transistor has its gate connected to the cathode of the diode and its source connected also to the ground potential.

BRIEF DESCRIPTION OF THE DRAWING

These and other objects and advantages of the present invention will become more fully apparent from the following detailed description when read in conjunction with the accompanying drawing in which there is shown a schematic circuit diagram of the bipolar/CMOS regulator circuit for generating a CMOS gate-controlling voltage.

DESCRIPTION OF THE PREFERRED EMBODIMENT

Referring now to the single drawing, there is shown a schematic circuit diagram of a BICMOS (bipolar/CMOS) regulator circuit 10 of the present invention for generating a CMOS gate-controlling voltage $V_R$, which varies favorable with temperature, power supply voltage, and process corners. In one particular application, the CMOS gate-controlling voltage $V_R$ is used as a gate bias voltage for an N-channel MOS transistor so as to yield a well-controlled current over the variations in temperature, power supply voltage and process. The regulator circuit is comprised of a bipolar bandgap regulator circuit portion 12 and a conversion circuit portion 14.

The bipolar bandgap regulator circuit portion 12 is of a conventional construction which is well-known in the art. The bandgap circuit portion 12 generates at its output terminal 16 a very precisely controlled reference voltage $V_{BG}$ which has a high stability over the temperature range of $-55°$ C. to $+125°$ C. and variations in the power supply voltage VCC of $+5.0$ volts $\pm 10\%$.

Typically, the precisely controlled reference voltage $V_{BG}$ at the output terminal 16 is set to be approximately equal to +1.2 to +1.3 volts which is fed to the conversion circuit portion 14. Further, this reference voltage $V_{BG}$ can be designed to have a desired temperature coefficient.

The conversion circuit portion 14 includes a current mirror section 18, a current source section 20, and an output section 22. The current mirror section 18 is formed of a pair of P-channel MOS transistors P1 and P2. The transistor P1 has its source electrode connected to a power supply voltage or potential VCC and has its gate and drain electrodes connected together. The transistor P2 has its source electrode also connected to the supply potential VCC and has its gate electrode connected to the gate electrode of the transistor P1. The current source section 20 is comprised of a first NPN-type bipolar transistor Q1 and an emitter resistor R1. The bipolar transistor Q1 has its collector connected to the gate and drain electrodes of the transistor P1 and has its emitter connected to one end of the resistor R1. The other end of the resistor R1 is connected to a ground potential. The base of the transistor Q1 is connected to the output terminal 16 of the bandgap circuit portion 12 for receiving the reference voltage $V_{BG}$.

The output section 22 includes a diode D1, a first N-channel MOS transistor N1, a second NPN-type bipolar transistor Q2, and a second N-channel MOS transistor N2. The anode of the diode D1 is connected to the drain electrode of the transistor P2 and to the base of the bipolar transistor Q2. The cathode of the diode D1 is connected to the drain and gate electrodes of the first N-channel transistor N1 and to the gate electrode of the second N-channel transistor N2. The source electrode of the transistor N1 is connected to the ground potential. The second bipolar transistor Q2 has its collector connected to the supply potential VCC. The emitter of the second bipolar transistor Q2 is connected to the drain of the second N-channel transistor N2 and to an output node 24 for producing the CMOS gate-controlling voltage $V_r$ at an output terminal 26. The source electrode of the second N-channel transistor N2 is also connected to the ground potential. It should be understood by those skilled in the art that the bandgap circuit portion and the conversion circuit portion is formed as an integrated circuit on a single semiconductor chip.

In operation, the current source section 20 formed of the bipolar transistor Q1 and the emitter resistor R1 is controlled by the bandgap reference voltage $V_{BG}$ to provide a constant current I which flows through the transistor Q1 and the resistor R1. The only possible variation in this current I is due to process variation of the resistance value in the resistor R1. In order to minimize this variation, the resistor R1 is preferably formed by ion implantation so as to maintain its value change to be as small as ±5% of the desired resistance value.

As will be recalled, the bandgap regulator 12 can be designed to provide the reference voltage $V_{BG}$ with a certain temperature coefficient. By combining the temperature coefficient of the resistor R1 with the temperature coefficient of the reference voltage $V_{BG}$ in the design considerations, a desired temperature coefficient of the constant current I can be achieved. This means that the current through the CMOS transistor N1 can be designed to also have a desired temperature coefficient.

Due to the current mirror section 18, when the gate and channel dimensions of the transistors P1 and P2 are sized substantially the same, the current I flowing through the transistor P1, the transistor Q1 and the resistor R1 will be mirrored through to the transistor P2 so that substantially the same current will flow through the diode D1 and the transistor N1. The transistor N1 functions to convert the constant current I to a CMOS reference voltage $V_G$ at the gate of the transistor N2 which is equal to the gate-controlling voltage $V_R$ at the output node 24 or output terminal 26.

The bipolar transistor Q2 and the N-channel transistor N2 serve to provide the gate-controlling voltage $V_R$ with a high drive capability and reduces loading effect. This gate-controlling voltage $V_R$ at the output terminal 26 is used to drive the gate electrode of an N-channel transistor (not shown) so as to provide a well-controlled current over the variations in temperature, power supply voltage and process corners. Typically, this gate-controlling voltage $V_R$ is approximately +1.3 volts.

From the foregoing detailed description, it can thus be seen that the present invention provides a bipolar/-CMOS regulator circuit for generating a CMOS gate-controlling voltage, which varies favorably with temperature, power supply voltage and process corners so as to yield a well-controlled CMOS current. The regulator circuit of the present invention is formed of a bandgap circuit portion and a conversion circuit portion. The conversion circuit portion is comprised of a current mirror section, a current source section, and an output section.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is;

1. A bipolar/CMOS regulator circuit for generating a CMOS gate-controlling voltage, which varies favorably with temperature, power supply voltage and process corners so as to yield a well-controlled CMOS current, said regulator circuit comprising:

a current mirror section (18) including a first P-channel MOS transistor (P1) and a second P-channel MOS transistor (P2), said first P-channel transistor (P1) having its source connected to a supply potential (VCC) and its gate and drain connected together, said second P-channel transistor (P2) having its source also connected to the supply potential (VCC) and its gate connected to the gate of said first P-channel transistor (P1);

a current source section (20) formed of a first bipolar transistor (Q1) and an emitter resistor (R1), said first bipolar transistor (Q1) having its collector connected to the drain of said first P-channel transistor (P1), its base connected to receive a regulated reference voltage, and its emitter connected to one end of the emitter resistor (R1), the other end of the emitter resistor (R1) being connected to a ground potential;

an output section (22) formed of a diode (D1), a first N-channel MOS transistor (N1), a second bipolar transistor (Q2), and a second N-channel MOS transistor (N2), said diode (D1) having its anode connected to the drain of said second P-channel transistor (P2) and its cathode connected to the gate and drain of said first N-channel transistor (N1), said first N-channel transistor (N1) having its source connected to the ground potential; and said second bipolar transistor (Q2) having its collector connected to the supply potential (VCC), its base connected to the anode of the diode (D1), and its emitter connected to the drain of said second N-channel transistor (N2) and to an output node for generating a CMOS gate-controlling voltage ($V_R$), said second N-channel transistor (N2) having its gate connected to the cathode of said diode (D1) and its source connected also to the ground potential.

2. A regulator circuit as claimed in claim 1, wherein said emitter resistor (R1) is formed by ion implantation so as to minimize variation in its resistance value.

3. A regulator circuit as claimed in claim 1, wherein said first bipolar transistor (Q1) is of an NPN-type conductivity.

4. A regulator circuit as claimed in claim 1, wherein said second bipolar transistor (Q2) is of an NPN-type conductivity.

5. A regulator circuit as claimed in claim 1, wherein said regulator circuit is formed as an integrated circuit on a single semiconductor chip.

6. A regulator circuit as claimed in claim 1, wherein said regulated reference voltage is provided by a bandgap circuit portion (12).

7. A bipolar/CMOS regulator circuit for generating a CMOS gate-controlling voltage, which varies favorably with temperature, power supply voltage and process corners so as to yield a well-controlled CMOS current, said regulator circuit comprising:

a current mirror section (18) including a first P-channel MOS transistor (P1) and a second P-channel MOS transistor (P2), said first P-channel transistor (P1) having its source connected to a supply potential (VCC) and its gate and drain connected together, said second P-channel transistor (P2) having its source also connected to the supply potential (VCC) and its gate connected to the gate of said first P-channel transistor (P1);

bandgap circuit means for generating a regulated reference voltage;

a current source section (20) formed of a first bipolar transistor (Q1) and an emitter resistor (R1), said first bipolar transistor (Q1) having its collector connected to the drain of said first P-channel transistor (P1), its base connected to receive the regulated reference voltage, and its emitter connected to one end of the emitter resistor (R1), the other end of the emitter resistor (R1) being connected to a ground potential;

an output section (22) formed of a diode (D1), a first N-channel MOS transistor (N1), a second bipolar transistor (Q2), and a second N-channel MOS transistor (N2), said diode (D1) having its anode connected to the drain of said second P-channel transistor (P2) and its cathode connected to the gate and drain of said first N-channel transistor (N1), said first N-channel transistor (N1) having its source connected to the ground potential; and said second bipolar transistor (Q2) having its collector connected to the supply potential (VCC), its base connected to the anode of the diode (D1), and its emitter connected to the drain of said second N-channel transistor (N2) and to an output node for generating a CMOS gate-controlling voltage ($V_R$), said second N-channel transistor (N2) having its gate connected to the cathode of said diode (D1) and its source connected also to the ground potential.

8. A regulator circuit as claimed in claim 7, wherein said emitter resistor (R1) is formed by ion implantation so as to minimize variation in its resistance value.

9. A regulator circuit as claimed in claim 8, wherein said first bipolar transistor (Q1) is of an NPN-type conductivity.

10. A regulator circuit as claimed in claim 9, wherein said second bipolar transistor (Q2) is of an NPN-type conductivity.

11. A regulator circuit as claimed in claim 10, wherein said regulator circuit is formed as an integrated circuit on a single semiconductor chip.

* * * * *